US006439346B1

(12) United States Patent
Gradziuk

(10) Patent No.: US 6,439,346 B1
(45) **Date of Patent: *Aug. 27, 2002**

(54) LIFTING DEVICE

(76) Inventor: David S. Gradziuk, 17 Lud Lane, Tamworth, Staffordshire B79 7EW (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/443,930

(22) Filed: Nov. 19, 1999

Related U.S. Application Data

(63) Continuation of application No. PCT/GB99/00870, filed on Mar. 19, 1999, and a continuation of application No. PCT/WO99/48799, filed on Mar. 19, 1999.

(30) Foreign Application Priority Data

Mar. 20, 1998 (GB) ..... 9805891

(51) Int. Cl.[7] ..... B66F 7/28

(52) U.S. Cl. ..... 187/216; 187/214; 187/217; 187/218; 187/219

(58) Field of Search ..... 187/210, 214, 187/216, 217, 218, 219; 254/13

(56) References Cited

U.S. PATENT DOCUMENTS 2,569,837 A * 10/1951 Villars
3,215,402 A * 11/1965 Hott et al.
3,655,082 A * 4/1972 Garrett
4,460,158 A * 7/1984 Chiesa et al. ..... 254/124
4,474,387 A * 10/1984 Maranell et al. ..... 254/DIG. 1
4,599,034 A * 7/1986 Kennedy et al.
4,659,100 A * 4/1987 Welker
4,662,617 A * 5/1987 Ditterline, Jr. et al. ..... 269/16
5,174,414 A 12/1992 Burns
5,609,461 A * 3/1997 Lichtenberg ..... 414/426

FOREIGN PATENT DOCUMENTS

| | | | | |
|---|---|---|---|---|
| BE | 000525747 | * | 6/1956 | ..... 187/210 |
| CH | 279430 | | 3/1952 | |
| GB | 1117615 | | 9/1965 | |

* cited by examiner

*Primary Examiner*—Robert P. Olszewski
*Assistant Examiner*—Steven B. McAllister

(57) ABSTRACT

The invention is a lifting device, particularly for lifting a motorcycle or similar vehicle. The apparatus comprises a base member adapted to support the apparatus on a level surface, a support beam extending laterally from the base member, a lifting column attached to the far end of the support beam and projecting vertically from the support beam. The lifting apparatus is in engagement with the lifting column, and is adapted to be raised and lowered along the column. The lifting apparatus is configured with detachable mountings for engaging a motorcycle or similar vehicle as well as a mechanism for supporting the motorcycle's kick stand.

7 Claims, 5 Drawing Sheets

LIFTING DEVICE

This application is a Con of Ser. No. PCT/GB99/00870 filed Mar. 19, 1999, which is a Con of PCT/WO99/48799 filed Mar. 19, 1999.

FIELD OF THE INVENTION

This invention relates to a lifting device and particularly (though not exclusively) to a lifting device for use in connection with a motor-cycle or similar vehicle.

SUMMARY OF THE INVENTION

The present invention therefore provides a lifting device comprising a base-member adapted in use to support the device on a substantially level surface, a support-beam extending laterally from the base-member, a lifting-column attached to the distal end of the support-beam and extending substantially perpendicularly upwardly therefrom, together with a lifting-assembly in operative engagement with the lifting-column, the lifting-assembly being adapted to be raised and lowered along the axis of the lifting-column.

Suitably, the base-member is of substantially "H"-shaped configuration. Preferably, the centre-rail of the "H" is of larger overall dimension than the side-rails of the "H".

Preferably, the lifting-assembly comprises a first beam extending substantially at 90° from the lifting column and in a plane substantially parallel to that of the base member, together with a second beam attached to the distal end of the first beam and extending substantially at 90° on either side of the first beam, the second beam also being in a plane substantially parallel to that of the base member.

The second beam of the lifting-assembly is suitably adapted, in use, to support beneath its engine area a vehicle to be lifted by means of a device according to the present invention.

For example, means may be provided which are adapted, in use, to engage and support the wheels and/or tires of a motor-cycle or similar vehicle.

Alternatively, means may be provided which are adapted, in use, to engage the rear suspension of a motor-cycle or similar vehicle and to support the vehicle from beneath the engine area.

Again alternatively, means may be provided which are adapted, in use, to engage the rear swing-arm and front forks of a motor-cycle or similar vehicle.

In a particularly preferred embodiment of the present invention, means are provided to engage and support the side-stand of a motor-cycle or similar vehicle. Such means may, for example, include a bracket-and-clamp assembly. The foot of the vehicle's own side-stand engages the bracket and is secured thereto by means of, say, a C-bolt and associated cap-screw. Preferably, the bracket-and-clamp assembly is pivotally attached to the lifting-means (for example, to the support-beam associated with the lifting-column) and is capable of being moved through 360° about its point of attachment.

Preferably, with reference to the lifting-assembly, the beam adapted, in use, to support the vehicle may be of hollow construction and adapted to receive one or more sets of mountings on which the vehicle is supported. For instance, mountings can be provided which support the vehicle at points beneath its chassis. Alternatively, mountings can be provided which support the vehicle at the base of the wheels or tires.

In a further embodiment of the present invention, the mountings are adapted for longitudinal and/or lateral movement relative to the beam.

In a yet further embodiment, the beam which is adapted, in use, to support the vehicle is provided with beam brackets, each bracket extending at substantially 90° to the longitudinal axis of the beam and being adapted, in use, to support vehicles such as custom vehicles, off-road bicycles or tricycles and four-wheeled "all-terrain" vehicles. One or more of the brackets may be provided with additional means (such as hook-bolts or the like) for further securing the vehicle before lifting. Again, each bracket can be adapted for movement relative to the beam.

The lifting-assembly may suitably be raised and lowered on the lifting-column by means of a threaded shaft (e.g. a trapezoidal screw-shaft) in association with a lifting nut acting on the lifting-beam. The shaft may be rotated by means of a drive-nut or the like. Rotation of the drive-nut can be achieved by mechanical means such as a crank-handle. Alternatively, the drive-nut can be rotated by means of a motor. Locking means such as a security-bolt may be provided to engage the lifting-beam so that the device can be locked in the raised position for added security.

In addition, provision can be made for adjusting the angle of the lifting-column relative to the ground or other surface, to compensate for any unevenness in the surface on which the lifting-device is to stand.

Thus, the present invention provides a secure, stable and versatile lifting device which is capable of lifting vehicles, especially motor-cycles and the like, to facilitate maintenance and repair work. The device according to the present invention can be readily portable and can be used on any relatively firm surface.

The present invention will be illustrated, merely by way of example, in the following description and with reference to the accompanying drawings.

BRIEF DESCRIPTION OF THE DRAWINGS

In the drawings (wherein like numerals denote like parts).

DETAILED DESCRIPTION OF THE PREFERRED EMBODIMENT

Figure 1:
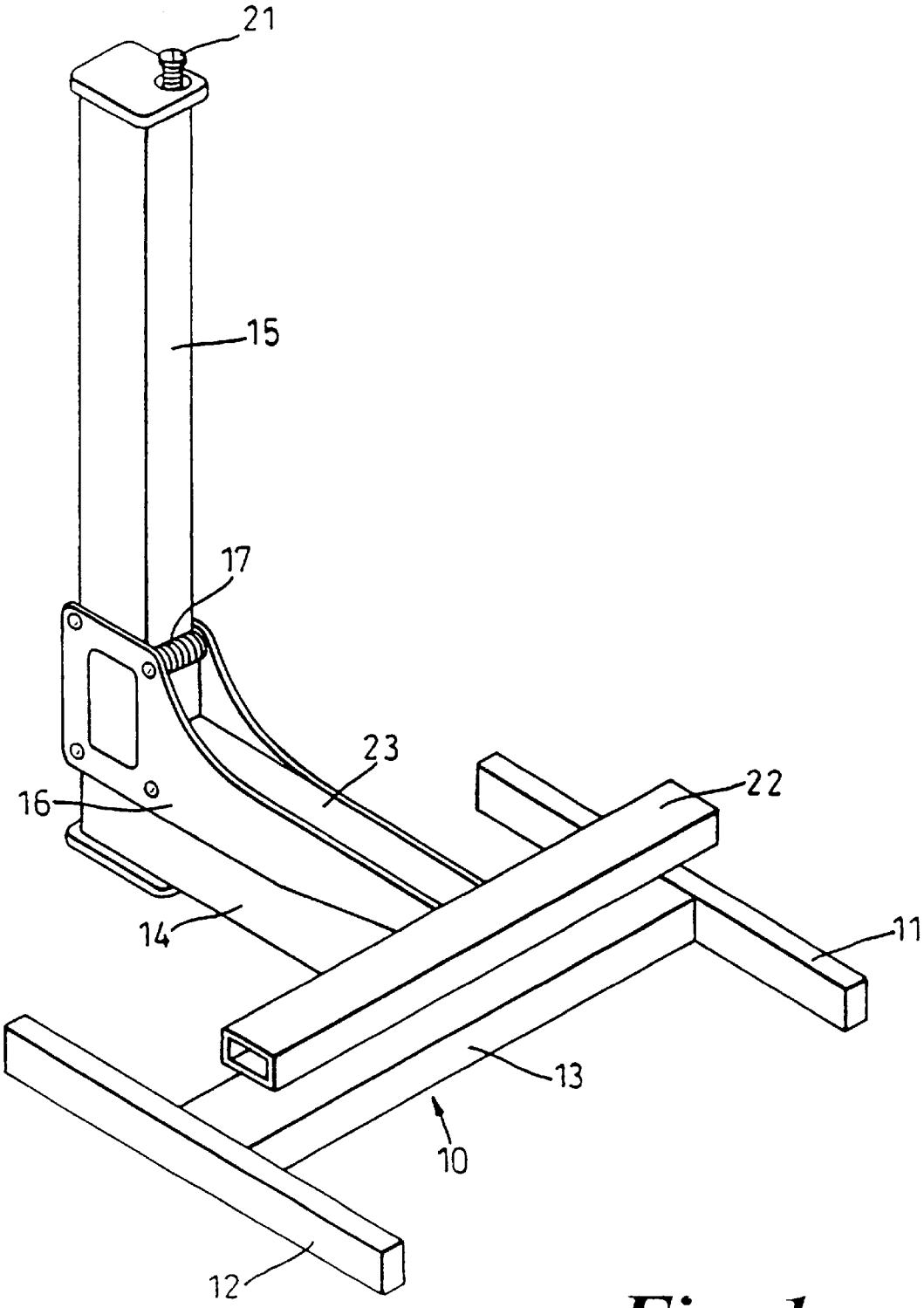
FIG. 1 is a perspective view of a lifting device according to the present invention.
Figure 2:
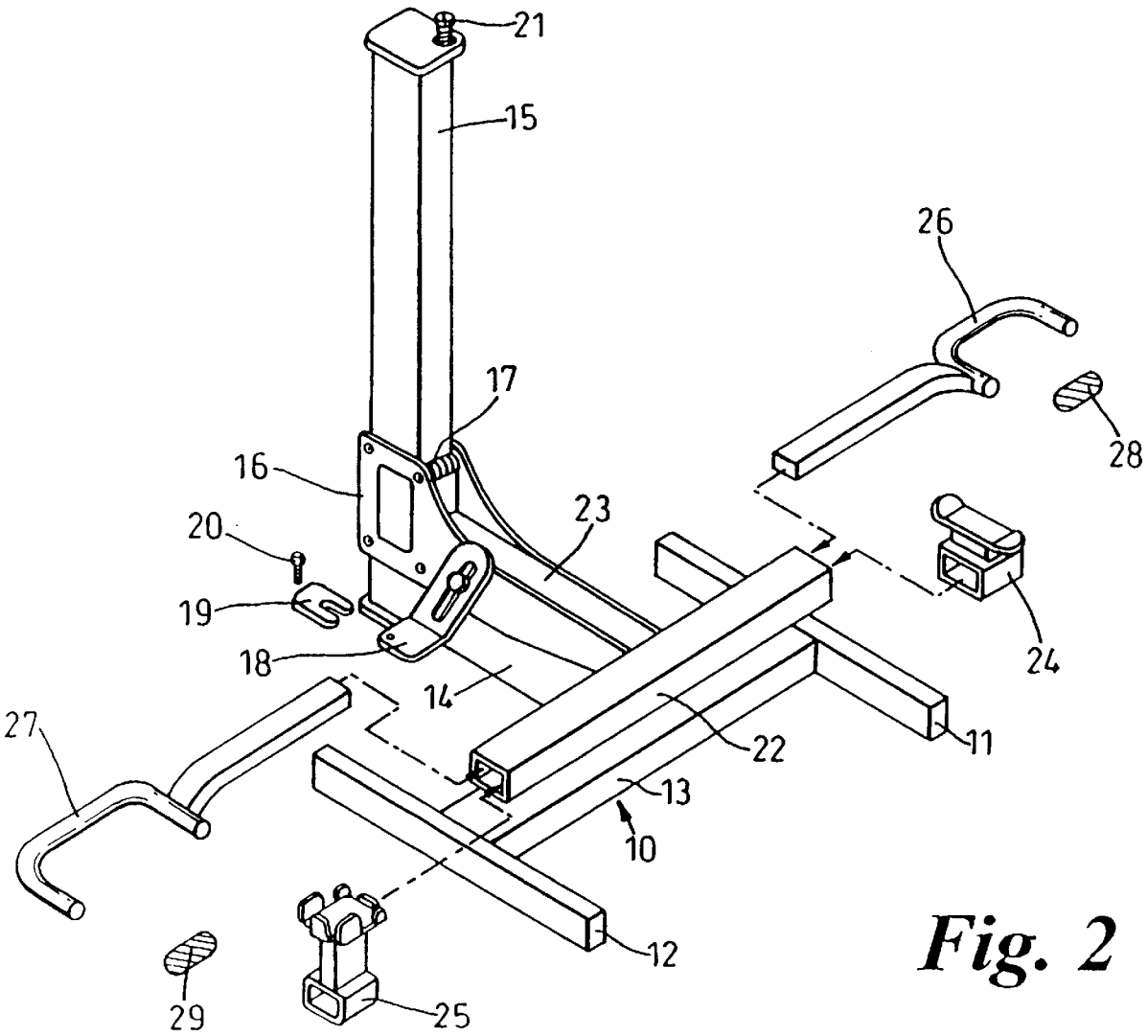
FIG. 2 shows the device of FIG. 1, including two alternative support means for a motor cycle or similar vehicle.

Referring to FIGS. 1 and 2, a lifting device according to the present invention comprises a generally H-shaped base 10 having side-rails 11 and 12 and a center-rail 13. Preferably, the center-rail 13 is of larger overall dimension than the side-rails 11 and 12.

The base 10 is supported on a support-beam 14 which extends at 90° from the centre of rail 13. The support-beam is attached, at its end remote from the base 10, to a vertical lifting-column 15 operatively associated with a lifting-beam 16. The lifting-beam is provided with rollers 17 (only one shown) to maintain contact with the lifting-beam 15 and to provide stability when the device is in use. A bracket 18 adapted, in use, to support a motor-cycle under its side-stand, is attached to the lifting-beam 16 and is provided with securing means comprising a C-clamp 19 and cap-screw 20 (see FIG. 2). Means operable by way of a drive-nut 21 are provided to raise and lower the lifting-beam 16 on the lifting-column 15.

A generally T-shaped lifting assembly, which in use supports the weight of a vehicle to be lifted, comprises a first beam 22 and a second beam 23, the second beam 23 being attached to and supported on the lifting-beam 16.

The beam 22 is of hollow rectangular section and is adapted to receive front and rear mountings, 24 and 25 respectively, whereby a vehicle to be lifted can be supported under its chassis. Alternatively, mountings 26 and 27 can be received in beam 22, these mountings being adapted in use to support a vehicle to be lifted at the base of its wheels or, tires. The general location of the wheels or tires is shown in FIG. 2 by "footprints" 28 and 29.

Figure 3:
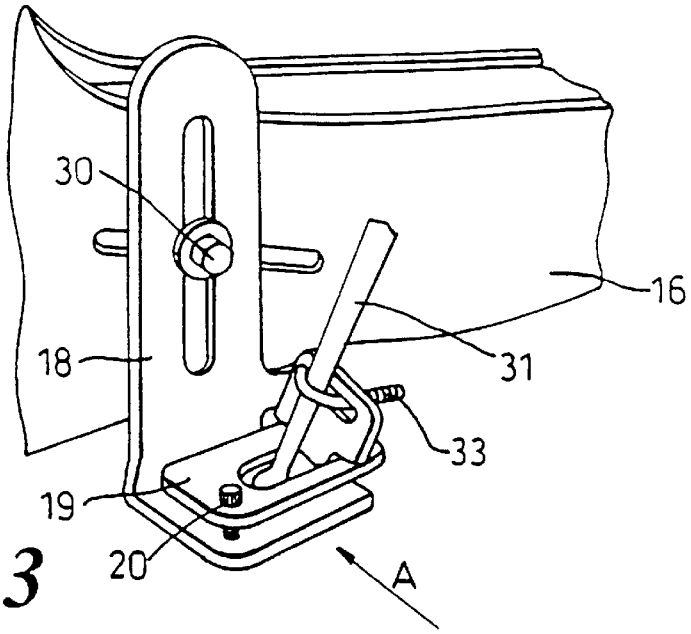
FIG. 3 is an enlarged perspective view of the support for a cycle side-stand shown in FIG. 2.
Figure 4:
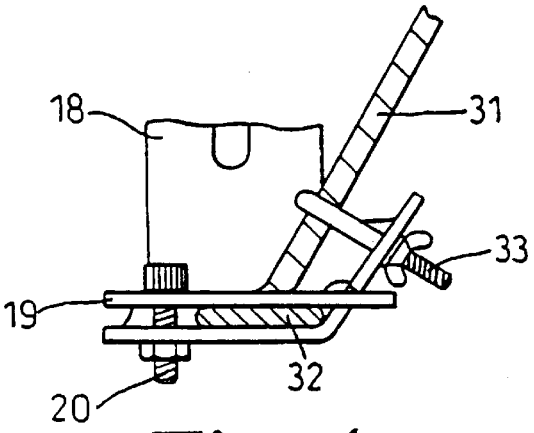
FIG. 4 is a view in the direction of arrow A in FIG. 3.

Referring to FIGS. 3 and 4, the bracket 18, attached by means of adjuster-bolt 30 to the lifting-beam 16, supports a motor-cycle or similar vehicle under the vehicle's own side-stand 31. The foot 32 of the side-stand is supported on bracket 18 and is secured against movement by means of C-clamp 19 and associated cap-screw 20, as well as by means of hook-bolt 33.

Figure 5:
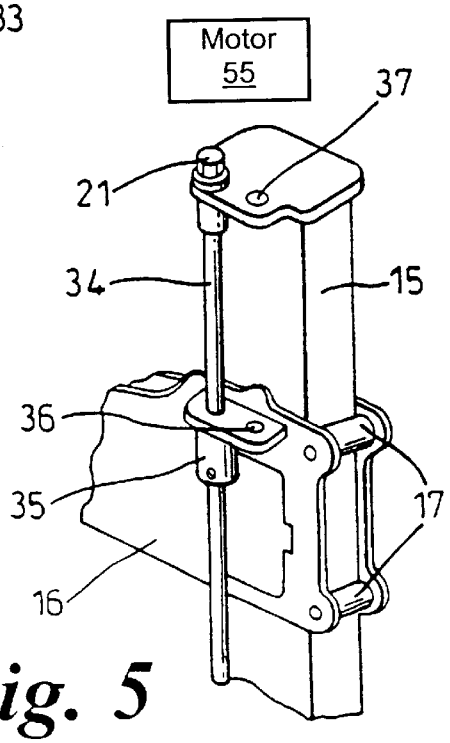
FIG. 5 is a part view of the lifting means of the device shown in FIGS. 1 and 2.

With reference to FIG. 5, the lifting-beam 16 is raised and lowered on the column 15 by means of a screw-shaft 34 acting on lifting-nut 35, the screw-shaft being rotated by rotation of the drive-nut 21. Drive-nut 21 can be rotated manually (e.g. by means of a crank-handle or the like). Alternatively, drive-nut 21 can be rotated by means of a motor 55. Locking means (for example a security-bolt) may be provided to secure the device in a raised position, the locking means being adapted to engage the lifting-beam through bolt-holes 36 and 37.

Figure 6:
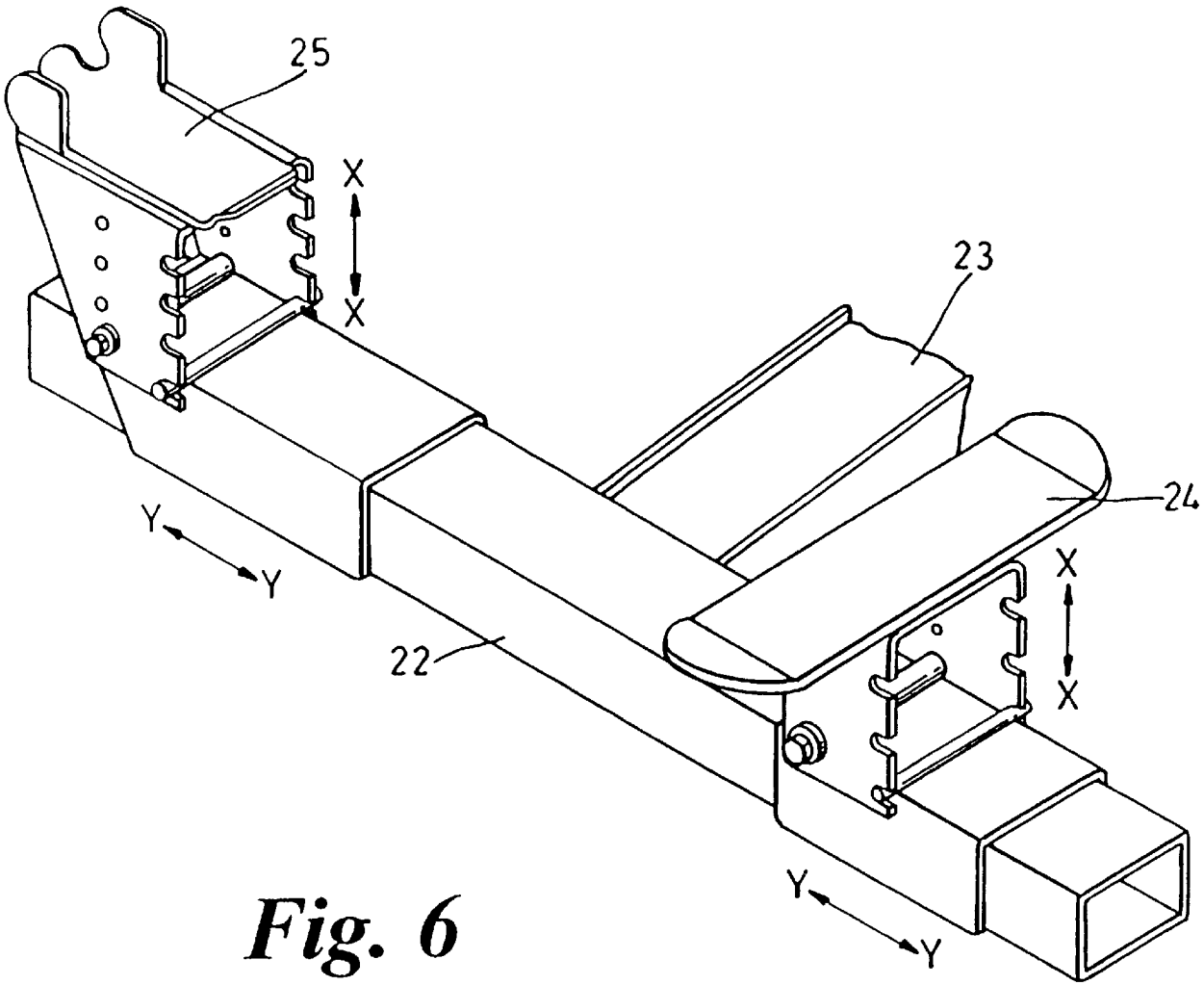
FIG. 6 is a perspective view of a further support means to be used in connection with the device shown in FIGS. 1 and 2.

In FIG. 6, there is shown a further embodiment of the lifting device of the present invention, wherein mountings 24 and 25 are adapted for movement relative to the beam 22, as shown by arrows XX and YY.

Figure 7:
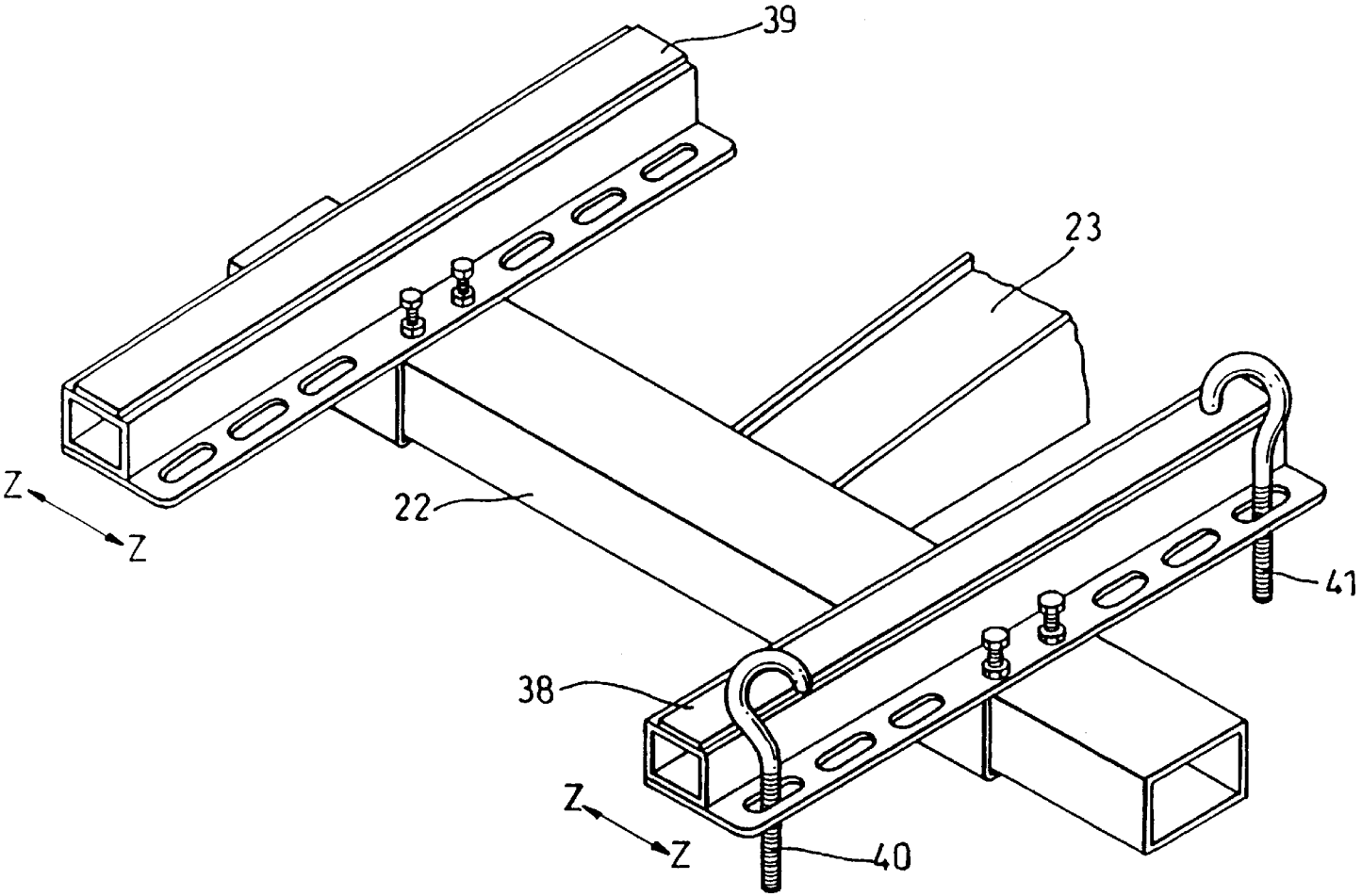
FIG. 7 is a perspective view of yet a further support means to be used in connection with the device shown in FIGS. 1 and 2.

In a still further embodiment, shown in FIG. 7, of the lifting device of the present invention, the beam 22 is provided with beam-brackets 38 and 39, by means of which custom vehicles, off-road bicycles or tricycles and four-wheeled "all-terrain" vehicles can be lifted. Bracket 38 is provided with additional hook-bolts 40 and 41 for further securing the vehicle before lifting. The brackets 38 and 39 are adapted for movement relative to the beam 22, as shown by arrows ZZ.

What is claimed is:

1. A lifting device for a motorcycle, said device comprising a base member, which in use acts to support said device on a substantially level surface, a support beam extending laterally from said base member, and a lifting column attached to the end of said support beam remote from said base member, said lifting column extending substantially perpendicularly upwardly from said support beam, together with a generally T-shaped lifting assembly in operative engagement with said lifting column, said lifting assembly being adapted to be raised and lowered along the axis of said lifting column;

wherein said generally T-shaped lifting assembly comprises a first beam extending substantially at 90 degrees from said lifting column and in a plane substantially parallel to that of said base member, together with a second beam attached to the end of said first beam remote from said lifting column, said second beam extending substantially at 90 degrees on either side of said first beam, said second beam also being in a plane substantially parallel to that of said base member;

wherein said second beam is of hollow rectangular section having open ends, said open ends being adapted to receive detachable mountings to support said motor-cycle above said substantially level surface;

wherein said lifting assembly further comprises a bracket-and-clamp assembly operatively associated with said lifting assembly and adapted to engage the side-stand of said motorcycle or similar vehicle;

and wherein said bracket-and-clamp assembly is pivotally atached to said lifting assembly and is capable of being moved through 360 degrees about said attachment.

2. The device of claim 1, wherein said lifting assebly includes a threaded shaft operatively associated with said lifting column, whereby rotation of said threaded shaft about its longitudinal axis results in upward or downward movement of said lifting assembly relative to said lifting column.

3. The device of claim 2, wherein said threaded shaft is adapted to be rotated manually.

4. The device of claim 2, wherein said threaded shaft is adapted to be rotated by means of a motor.

5. The device of claim 1, wherein said bracket-and-clamp assembly comprises a bracket to receive and support the foot of said side-stand, a C-clamp movably mounted on said bracket and extending, in use, around said foot of said side-stand and a hook-bolt securing, in use, said side-stand against movement relative to said bracket.

6. The lifting device of claim 1, wherein said detachable mountings are shaped so as to support said motorcycle from beneath the engine area.

7. The device of claim 1, wherein said base member is of substantially "H" - shaped configuration.

* * * * *